US010239337B2

(12) United States Patent
Zhou et al.

(10) Patent No.: US 10,239,337 B2
(45) Date of Patent: Mar. 26, 2019

(54) PRINTABLE RECORDING MEDIA

(71) Applicant: Hewlett-Packard Development Company, L.P., Houston, TX (US)

(72) Inventors: Xiaoqi Zhou, San Diego, CA (US); Xulong Fu, San Diego, CA (US); Haowen Yu, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/541,672

(22) PCT Filed: Jan. 28, 2015

(86) PCT No.: PCT/US2015/013269
§ 371 (c)(1),
(2) Date: Jul. 5, 2017

(87) PCT Pub. No.: WO2016/122485
PCT Pub. Date: Aug. 4, 2016

(65) Prior Publication Data

US 2018/0022138 A1 Jan. 25, 2018

(51) Int. Cl.
*B41M 5/00* (2006.01)
*B41M 5/50* (2006.01)
(Continued)

(52) U.S. Cl.
CPC ..... *B41M 5/502* (2013.01); *B41J 2/01* (2013.01); *B41M 5/504* (2013.01); *B41M 5/506* (2013.01);
(Continued)

(58) Field of Classification Search
CPC ..... B41M 5/502; B41M 5/504; B41M 5/506; B41M 5/508; B41M 5/5218; B41M 5/5245
See application file for complete search history.

(56) References Cited

U.S. PATENT DOCUMENTS 585,855 A 7/1897 Sully
5,660,928 A 8/1997 Stokes et al.
(Continued)

FOREIGN PATENT DOCUMENTS

CN 102597371 7/2012
CN 103370473 10/2013
(Continued)

OTHER PUBLICATIONS

International Search Report and Written Opinion for International Application No. PCT/US2015/013269 dated Oct. 27, 2015, 11 pages.

*Primary Examiner* — Betelhem Shewareged
(74) *Attorney, Agent, or Firm* — HP Inc. Patent Department

(57) ABSTRACT

Disclosed herein is a printable recording media including a substrate and, at least, an ink receiving layer that includes a first distinct layer and a second distinct layer that is applied on top of the first distinct layer. The first distinct layer includes an electrical charged substance and the second distinct layer includes, at least, a polymeric binder and nano-size inorganic pigment particles. Also disclosed herein is a method for making the printable recording media.

15 Claims, 2 Drawing Sheets

(51) Int. Cl.
*B41M 5/52* (2006.01)
*B41J 2/01* (2006.01)

(52) U.S. Cl.
CPC ..... *B41M 5/508* (2013.01); *B41M 5/5218* (2013.01); *B41M 5/5245* (2013.01); *B41M 2205/36* (2013.01); *B41M 2205/38* (2013.01)

(56) References Cited

U.S. PATENT DOCUMENTS

| | | | | |
|---|---|---|---|---|
| 5,798,179 | A | 8/1998 | Kronzer | |
| 6,028,028 | A | 2/2000 | Nitta | |
| 6,040,060 | A | 3/2000 | Missel et al. | |
| 6,447,883 | B1 | 9/2002 | Chen et al. | |
| 6,458,413 | B1 | 10/2002 | Hirabayashi et al. | |
| 6,902,794 | B2 | 6/2005 | Hirabayashi et al. | |
| 7,056,969 | B2 | 6/2006 | Cuch et al. | |
| 7,569,255 | B2 | 8/2009 | Dannhauser et al. | |
| 7,829,160 | B2 | 11/2010 | Schultz et al. | |
| 8,158,222 | B2 | 4/2012 | Kaimoto et al. | |
| 8,227,054 | B2 | 7/2012 | Ono et al. | |
| 8,377,522 | B2 | 2/2013 | Desrousseaux et al. | |
| 8,733,918 | B2 | 5/2014 | Sasada et al. | |
| 8,771,811 | B2 | 7/2014 | Takahashi et al. | |
| 2001/0009174 | A1 | 7/2001 | Dinkel et al. | |
| 2002/0182376 | A1 | 12/2002 | Mukherjee et al. | |
| 2003/0174195 | A1* | 9/2003 | Onishi | B41J 2/325 347/105 |
| 2004/0009301 | A1 | 1/2004 | Xing et al. | |
| 2004/0058098 | A1 | 3/2004 | Kondo et al. | |
| 2004/0197498 | A1 | 10/2004 | Bi et al. | |
| 2005/0007434 | A1 | 1/2005 | Anagnostopoulos et al. | |
| 2005/0238826 | A1 | 10/2005 | Bi et al. | |
| 2006/0045998 | A1 | 3/2006 | Kitamura et al. | |
| 2006/0050130 | A1* | 3/2006 | Yoshida | B41M 5/52 347/105 |
| 2007/0003716 | A1* | 1/2007 | Suzuki | B41M 5/502 428/32.36 |
| 2007/0202264 | A1* | 8/2007 | Ruschak | B41M 5/506 427/407.1 |
| 2007/0202280 | A1 | 8/2007 | Khoultchaev et al. | |
| 2007/0207278 | A1 | 9/2007 | Mukherjee et al. | |
| 2009/0109270 | A1* | 4/2009 | Kobayashi | B41M 5/506 347/106 |
| 2009/0110910 | A1 | 4/2009 | Kaimoto et al. | |
| 2009/0130312 | A1 | 5/2009 | Ono et al. | |
| 2009/0246386 | A1 | 10/2009 | Kaimoto et al. | |
| 2011/0242192 | A1 | 10/2011 | Sasada et al. | |
| 2011/0244147 | A1 | 10/2011 | Wang et al. | |
| 2012/0225223 | A1 | 9/2012 | Takahashi et al. | |
| 2014/0139601 | A1* | 5/2014 | Pal | B41M 5/506 347/105 |

FOREIGN PATENT DOCUMENTS

| | | |
|---|---|---|
| EP | 0943450 | 9/1999 |
| EP | 1329330 | 7/2003 |
| EP | 1346842 | 9/2003 |
| EP | 2106923 | 10/2009 |
| JP | 2002264467 | 9/2002 |
| JP | 2003266918 | 9/2003 |
| JP | 2014109075 | 6/2014 |

* cited by examiner

PRINTABLE RECORDING MEDIA

BACKGROUND

Inkjet printing is a non-impact printing method in which an electronic signal controls and directs droplets or a stream of ink that can be deposited on a variety of substrates. Current inkjet printing technology involves forcing the ink drops through small nozzles by thermal ejection, piezoelectric pressure or oscillation, onto the surface of a media. This technology has become a popular way of recording images on various media surfaces, particularly paper, for a number of reasons, including low printer noise, capability of high-speed recording and multi-color recording. Inkjet web printing is a technology that is specifically well adapted for commercial and industrial printing. An example of such printing technology is the "HP Page Wide Array printing" where more than hundreds of thousand tiny nozzles on a stationary printhead that spans the width of a page, delivering multi-colors ink onto a moving sheet of paper under a single pass to achieve the super-fast printing speed.

With these printing technologies, it is apparent that the image quality of printed images is strongly dependent on the construction of the recording media used. Consequently, recording media with improved performances and characteristics have been developed.

BRIEF DESCRIPTION OF THE DRAWINGS

The drawings illustrate various embodiments of the present recording media and are part of the specification.

DETAILED DESCRIPTION

Figure 1:
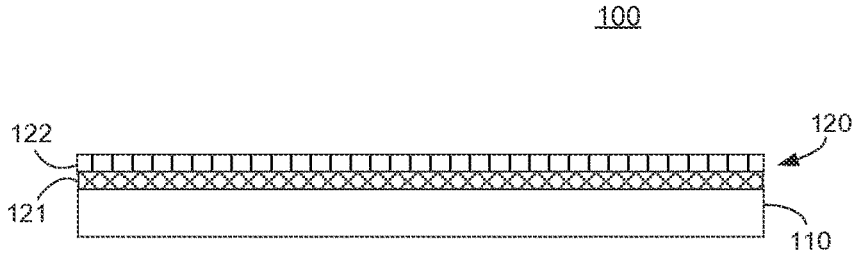
FIGS. 1, 2 and 3 are cross-sectional views of the printable recording media according to embodiments of the present disclosure.

The present disclosure refers to a printable recording media comprising a substrate and, at least, an ink receiving layer including a first distinct layer with an electrical charged substance, and, applied on top of the first distinct layer, a second distinct layer containing, at least, a polymeric binder and nano-size inorganic pigment particles. The present disclosure refers also to a method for making the printable recording media.

Before particular embodiments of the present disclosure are disclosed and described, it is to be understood that the present disclosure is not limited to the particular process and materials disclosed herein. It is also to be understood that the terminology used herein is used for describing particular embodiments only and is not intended to be limiting, as the scope of protection will be defined by the claims and equivalents thereof. In describing and claiming the present article and method, the following terminology will be used: the singular forms "a", "an", and "the" include plural referents unless the context clearly dictates otherwise. Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For examples, a weight range of about 1 wt % to about 20 wt % should be interpreted to include not only the explicitly recited concentration limits of 1 wt % to 20 wt %, but also to include individual concentrations such as 2 wt %, 3 wt %, 4 wt %, and sub-ranges such as 5 wt % to 15 wt %, 10 wt % to 20 wt %, etc. All percent are by weight (wt %) unless otherwise indicated. As used herein, "image" refers to marks, signs, symbols, figures, indications, and/or appearances deposited upon a material or substrate with either visible or an invisible ink composition. Examples of an image can include characters, words, numbers, alphanumeric symbols, punctuation, text, lines, underlines, highlights, and the like.

In some examples, the printable recording media is an inkjet printable medium. The substrate can thus be specifically designed to receive any inkjet printable ink, such as, for example, organic solvent-based inkjet inks or aqueous-based inkjet inks Examples of inkjet inks that may be deposited, established, or otherwise printed on the printable substrate, include pigment-based inkjet inks, dye-based inkjet inks pigmented, latex-based inkjet inks and UV curable inkjet inks.

The printable recording media, described herein, provides printed images and articles that demonstrate excellent image quality (such as vivid color gamut, low ink bleed and good coalescence performance) while enabling high-speed printing. By high-speed printing, it is meant herein that the printer can generate up to 30 sheet of arch D size (610 mm×915 mm) per minute with full colored images for examples. The printable recording media provides printed images that can be present in various surface finishing such as matte, satin and gloss. The recording media can also be textured to create various art effects. The recording media have an optimized absorptivity. The resulting printed article and image have, therefore, outstanding print quality. In some examples, the images printed on the recording media, such as described herein, are able to impart excellent image quality: provides vivid color, such as higher gamut and have a different levels of gloss, and high color density. High print density and color gamut volume are realized with substantially no visual color-to-color bleed and with good coalescence characteristics.

The printable recording media provides printed images that do not show visible print mottle. Print mottle or mottling is a defect that often presents as uneven random color patterns in a large area of an image. It is believed that uneven absorption of ink vehicle in the coating layer causes this defect, a result of uneven coat weight/thickness on base paper, and/or variation of pore structure in the coating layer. For coated paper, the underneath base paper is usually rougher than the final sheets. During coating process, the thickness of the coating layer may vary with any bumps and valleys on the base paper surface. Even with precise coating methods, there is often uneven coating thickness across the web. Since the absorption of liquid in coating layer is different than absorption in the base paper, variation of the coat weight is a major cause of print mottle. In addition, coated paper usually goes through a calender or super calender step after the coating process in order to produce a smother surface and/or higher gloss products. Under pressure and/or high temperature, the pores in the coating layer will deform. Due to uneven base paper and variation of coating thickness, calendering can easily cause differences in pore structure, i.e., patterns of pore size distribution and pore shape. Such differences might, in many cases, cause variation of ink penetration rate in the coating layer, and eventually exacerbate a print mottle defect. In addition, the printable recording media has, in the same time, excellent surface smoothness and a high absorptivity. The resulting printed article and image have, therefore, outstanding print durability and print quality.

The printable recording media, described herein, is considered to have improved flatness and decreased cockling problems, issues that are often founded in high speed printing applications. Indeed, some paper media can be subjected to problems relating to one or more of cockle, curl, wrinkle, crease, and/or mis-registration, which can detrimentally impact productivity, product quality and cost. For example, inkjet printing has a much higher moisture level than offset and gravure printing due to the colored pigments of the inkjet ink being applied to the paper media using, for example, a water based liquid vehicle, which might cause non-uniform hygro-expansion. Cockle refers to a small scale expansion in paper fiber width when wetted with water that might come from water-based inkjet inks.

The printable media has an optimized absorption rate. The resulting printed article and image have, therefore, outstanding print quality. By "optimized absorption rate", it is meant that the water, solvent and/or vehicle of the ink can be absorbed by the media at a fast rate so that the ink composition does not have a chance to interact and cause bleed and/or coalescence issues and also not caused any ink transfer to any rollers inside the paper path of the printer. On another hand, the recording media is also constructed in order to avoid any excessive absorption of the ink colorant (pigments) so that ink optical density and color gamut are decreased. The faster the printing speed and the higher the amount of ink used, the higher is the demand on faster absorption from the media. A good diagnostic plot with maximum ink density, such as secondary colors, would be prone to coalescence and a pattern of lines of the primary and secondary colors passing through area fills of primary and secondary colors would be prone to bleed. If no bleed or coalescence is present at the desired printing speed, the absorption rate would be sufficient. Bristow wheel measurements can be used for a quantitative measure of absorption on media wherein a fixed amount of a fluid is applied through a slit to a strip of media that moves at varying speeds. In some examples, the printing substrate has an ink absorption rate that is not less than 10 $ml/m^2 \times sec^{1/2}$, as measured by Bristow wheel ink absorption method. (The Bristow wheel is an apparatus also called the Paprican Dynamic Sorption Tester, model LBA92, manufactured by Op Test Equipment Inc.)

In some examples, the printing substrate has a surface smoothness that is less than 150 Sheffield smoothness unites. In some other examples, the printing substrate has a surface smoothness that is less than 100 Sheffield smoothness unite. In yet some other examples, the printing substrate has a surface smoothness that ranges between from about 30 to about 90 Sheffield smoothness unite. The Surface smoothness is measured with a Hagerty smoothness tester (Per Tappi method of T-538 om-96). This method is a measurement of the airflow between the specimen (backed by flat glass on the bottom side) and two pressurized, concentric annular lands that are impressed into the sample from the top side. The rate of airflow is related to the surface roughness of paper. The higher the number is, the rougher the surfaces. The unit is SU (Sheffield smoothness unit).

In some examples, the media according to the present disclosure exhibit TAAPI brightness of at least 80%. In some other examples, the printable recording media has a TAAPI brightness that is at least 85% (on a scale of 1 to 100). The Tappi brightness is measured using TAPPI Standard T452, "Brightness of pulp, paper, and paperboard (directional reflectance at 457 nm)" by means of Technidyne Brightmeter. Measurements are made at 457 nm blue light at a 45° angle and reported.

In some examples, the printable recording media used herein is a coated glossy medium that can print at speeds needed for commercial and other printers such as, for example, a Hewlett Packard (HP) Inkjet Web Press (Hewlett Packard Inc., Palo Alto, Calif., USA). The properties of the print media in accordance with the principles described herein are comparable to coated media for offset printing. The printable recording media can have a 75° gloss (sheet gloss) that is greater than 30%; or that is greater than 45%. Such gloss is referred as the "Sheet Gloss" and measures how much light is reflected with a 75 degree (o) geometry on the unprinted recording media. 75° Sheet Gloss testing is carried out by Gloss measurement of the unprinted area of the sheet with a BYK-Gardner Micro-Gloss® 75o Meter (BYK-Gardner USA, Columbia, Md., USA).

Figure 2:
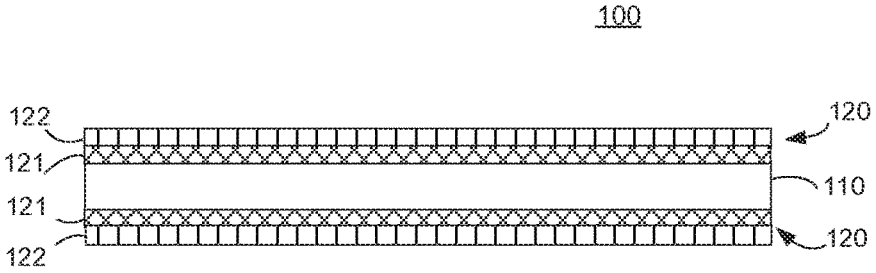
Figure 3:
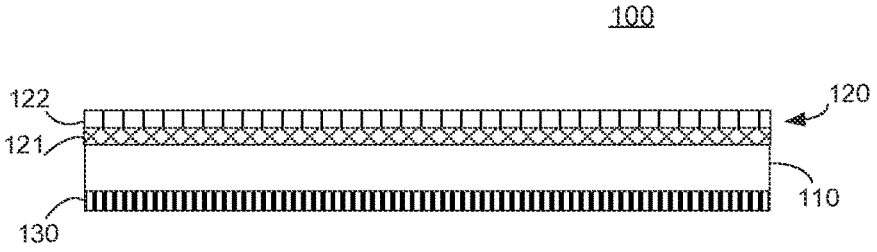
Figure 4:
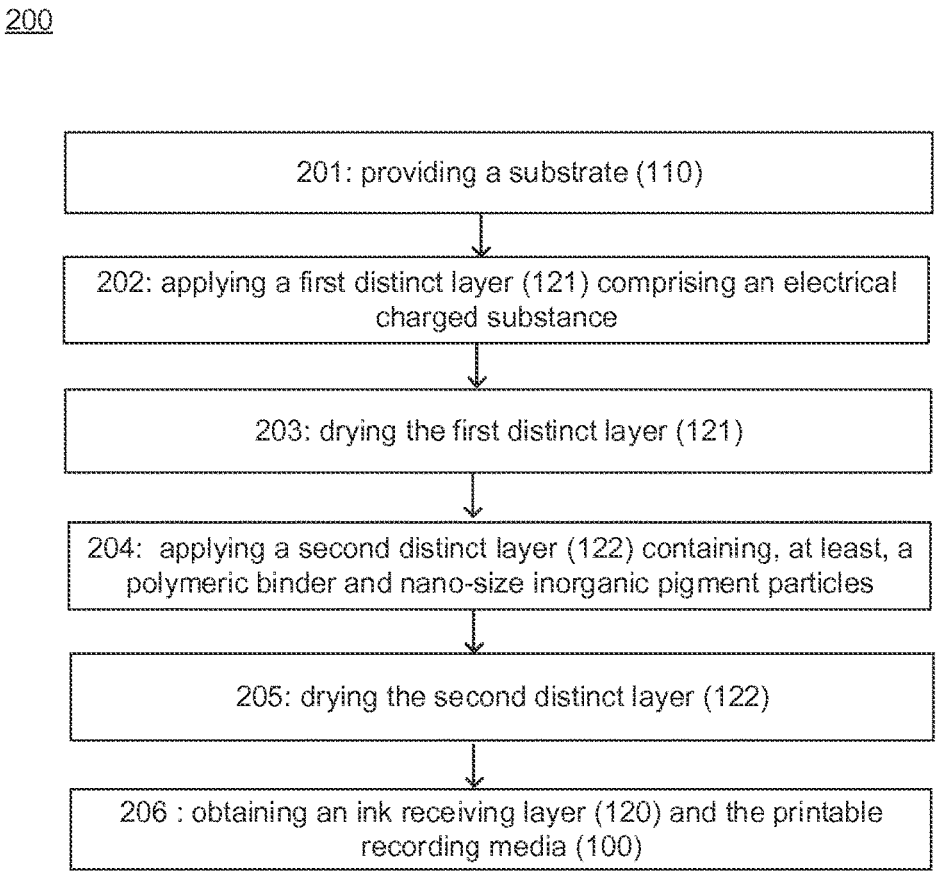
FIG. 4 is a flow chart of a method for making a printable recording media in accordance with an example of the present disclosure.

FIG. 1, FIG. 2 and FIG. 3 illustrate the printable recording media (100) as described herein. In some examples, as illustrated in FIG. 1, the printable media (100) encompasses a substrate (110) and an ink receiving layer (120). The ink receiving layer (120) is applied on, at least, one side of the substrate (110). The image receiving layer is thus applied on one side only and no other coating is applied on the opposite side. In some other examples, such as illustrated in FIG. 2, the ink receiving layer (120) is applied to both opposing sides of the substrate (110). The double-side coated media has thus a sandwich structure, i.e. both sides of the substrate (110) are coated and both sides may be printed. If the coated side is used as an image-receiving side, the other side, i.e. backside, may not have any coating at all, or may be coated with other chemicals (e.g. sizing agents) or coatings to meet certain features such as to balance the curl of the final product or to improve sheet feeding in printer. In yet some examples, such as illustrated in FIG. 3, the printable recording media (100) contains an ink receiving layer (120) on one side of the substrate (110) and a backing coating layer (130) on the other side of the substrate, i.e. the side that will not receive any image (non-imaging side or backside). Such backing coating layer will help to balance coating stress to prevent media curling. As illustrated in FIGS. 1, 2 and 3, the printable media (100) encompasses a substrate (or bottom supporting substrate) (110) and an ink receiving layer (120) that is made of a first distinct layer (121) and of a second distinct layer (122). FIG. 4 is a flow chart of a method for making the printable recording media in accordance with an example of the present disclosure.

The present disclosure refers to a printable recording media that comprises a substrate and, at least, an ink receiving layer. The ink receiving layer is made of two distinct layers: a first layer or "ink fixation layer" comprising an electrical charged substance, and, applied on top of the first layer, a second distinct layer or "ink fusion layer" containing, at least, a polymeric binder and nano-size inorganic pigment particles. The printable media, as described herein, can be considered as an article or as a coated article. The article comprises a cellulose paper substrate having, on its image side (or image receiving side), an ink fixation layer and an ink fusion layer wherein the ink fusion layer is applied over the ink fixation layer as a distinct layer and wherein the difference in coating thickness in Z-direction is, at least, 1:10.

Substrate

As illustrated in FIG. 1, the printable media (100) contains a substrate (110) that supports the ink receiving layer(s)

(120) and that acts as a bottom substrate layer or supporting base. Such substrate, which can also be called base print media substrate or base substrate or supporting substrate, contains a material that serves as a base upon which the ink receiving layers are applied and, eventually, the backing coating layer. The substrate provides integrity for the resultant printable media. The amount of the ink receiving layer, on the media, in the dry state, is, at least, sufficient to hold all of the ink that is to be applied to the media.

The basis weight of the print media substrate is dependent on the nature of the application of the printable recording media where lighter weights are employed for magazines, books and tri-folds brochures and heavier weights are employed for post cards and packaging applications, for example. The substrate can have a basis weight of about 60 grams per square meter (g/m$^2$ or gsm) to about 400 gsm, or of about 100 gsm to about 250 gsm.

In some examples, the substrate is a paper base substrate. The media substrate can also be a photo-base paper, an uncoated plain paper or a plain paper having a porous coating, such as a calendared paper, an un-calendared paper, a cast-coated paper, a clay coated paper, or a commercial offset paper. The photobase may be a paper that is coated by co-extrusion with a high- or low-density polyethylene, polypropylene, or polyester on both surfaces of the paper. The substrate may include any materials which can support a coating composition, for example, natural materials (such as a base including cellulose fibers) or synthetic material, (such as a base including synthetic polymeric fibers) or non-fabric materials (such as a polymeric film) or a mixture of them. The substrate material has good affinity and good compatibility for the ink that is applied to the material. Examples of substrates include, but are not limited to, natural cellulosic material, synthetic cellulosic material (such as, for example, cellulose diacetate, cellulose triacetate, cellulose propionate, cellulose butyrate, cellulose acetate butyrate and nitrocellulose). The synthetic material can be in fabric form such as woven fabric or a non-woven synthetic fabric material, and also, in non-fabric form such as films. The synthetic material includes, one or more polymers such as, for example, polyolefins, polyesters, polyamides, ethylene copolymers, polycarbonates, polyurethanes, polyalkylene oxides, polyester amides, polyethylene terephthalate, polyethylene, polystyrene, polypropylene, polycarbonate, polyvinyl acetal, polyalkyloxazolines, polyphenyl oxazolines, polyethylene-imines, polyvinyl pyrrolidones, and combinations of two or more of the above. The media substrate can be a paper base including paper, cardboard, paperboard, paper laminated with plastics, and paper coated with resin. The substrate may include polymeric binders with binding power in order to improve the integrity of the substrate.

In some examples, the substrate is a cellulose based substrate, meaning thus that it contains cellulosic fibers. The cellulose base could be made from pulp stock containing a fiber ratio (hardwood fibers to softwood fibers) of 70:30. The hardwood fibers have an average length ranging from about 0.5 mm to about 1.5 mm. These relatively short fibers improve the formation and smoothness of the base. Suitable hardwood fibers can include pulp fibers derived from deciduous trees (angiosperms), such as birch, aspen, oak, beech, maple, and eucalyptus. The hardwood fibers may be bleached or unbleached hardwood fibers. Rather than virginal hardwood fibers, other fibers with the same length, up to 20% of total hardwood fiber content, can be used as the hardwood fiber. The other fibers may be recycled fibers, non-deinkable fibers, unbleached fibers, synthetic fibers, mechanical fibers, or combinations thereof. The softwood fibers have an average length ranging from about 2 mm to about 7 mm. These relatively long fibers improve the mechanical strength of the base. Suitable softwood fibers can include pulp fibers derived from coniferous trees (gymnosperms), such as varieties of fir, spruce, and pine (e.g., loblolly pine, slash pine, Colorado spruce, balsam fir, and Douglas fir). The fibers may be prepared via any known pulping process, such as, for example, chemical pulping processes. Two suitable chemical pulping methods include the kraft process and the sulphite process.

The fibers of the substrate material may be produced from chemical pulp, mechanical pulp, thermal mechanical pulp, chemical mechanical pulp or chemical thermo-mechanical pulp. Examples of wood pulps include, but are not limited to, Kraft pulps and sulfite pulps, each of which may or may not be bleached. The substrate may also include non-cellulose fibers. The pulp used to make the cellulose base may also contain up to 10 wt % (with respect to total solids) of additives. Suitable additives may be selected from a group consisting of a dry strength additive, wet strength additive, a filler, a retention aid, a dye, an optical brightening agent (i.e., optical brightener), a surfactant, a sizing agent, a biocide, a defoamer, or a combination thereof.

Ink Receiving Layer

The printable recording media comprises a substrate (110) and, at least, an ink receiving layer (120) disposed on, at least, one side of the substrate. In some example, the ink receiving layer or inkjet receiving or ink recording layer or image receiving layer, is present on, at least, one side of the substrate (110). In some other examples, the ink receiving layer (120) is present on both sides of the substrate (110).

The ink receiving layer is formed with two distinct layers. The ink receiving layer, or coating, includes an ink fixation layer (121) as a first distinct layer, and a second layer (122) that is applied on top of said first distinct layer, as a second distinct layer. The word "distinct" refers herein to the fact that the layers have significant difference in coating thickness in Z-direction, for examples. In some examples, the difference in coating thickness in Z-direction, between the first and the second layers, is of, at least 1:10; or, in some other examples, is of, at least, 1:50, or, in yet some other examples, is of at least 1:100.

The ink receiving layer could be considered as a composite structure. The word "composite" refers herein to a material made from at least two constituent materials, or layers, that have different physical and/or chemical properties from one another, and wherein these constituent materials/layers remain separate at a molecular level and distinct within the structure of the composite.

The ink receiving layer (120) can be disposed on one side the supporting substrate (110) and can form a layer having a coat-weight in the range of about 0.5 to about 30 gram per square meter (g/m$^2$ or gsm), or in the range of about 1 to about 20 gsm, or in the range of about 1 to about 15 gsm per side. In some examples, the printable recording media has an ink receiving layer (120) that is applied to only one side of the supporting substrate (110) and that has a coat-weight in the range of about 2 to about 10 gsm. In some other examples, the printable recording media contains ink receiving layer (120) that is applied to both sides of the substrate (110) and that has a coat-weight in the range of about 1 to about 10 gsm per side.

The ink receiving layer (120) comprises, as a first distinct layer or "ink fixation layer" (121). The first distinct layer that is applied directly on outmost surface of cellulose base could be called "ink fixation layer" since one of the function of this layer is to be a physical layer to block ink colorants, also known as pigments movement, along the z-direction by electronic charging interaction. The electronic charging interaction refers to positively or negatively charged species, in the ink fixation layer, that can be coupled together with the opposite charged species, in the ink composition, that chemically and/or physically forms a neutralized pair. Without being linked by any theory, it is believed that the first distinct layer has multiple functions. First of all, it can be able, when receiving ink drops, to crash or to separate ink pigment from ink solvent. Secondly, it can be able to chemically and/or physically bond ink pigments and prevent pigments to further penetrate into the cellulose base but let ink solvent vehicle flow into the base instantly. Not bonded to any theory, it is believed that migration of ink pigments into cellulose base will decrease color gamut and therefore reduce printing quality. In addition, such interaction can also immobilize the ink colorants in order to reduce randomly colorant migration along the x-y direction, a less ink bleed and sharp edge definition image can thus be produced.

The first distinct layer or "ink fixation layer", as described herein, does not include a "physical barrier layer" that will stop pigment migration towards base, i.e. layer that will "physically block" pigment migration along z-direction since these layers will also inevitably stop or reduce the ink solvent vehicle movement and, in turn, will reduce ink dry time. Examples of physical layers that are excluded include: coatings containing inorganic and/or organic fillers and binder(s); coating layers made from film-forming polymers that form a continuous layer; layers that are made by applying polymeric or similar substance using heated method such as extrusion coating; and coatings which are formed by laminating sheeted materials such as plastic-paper, fabric-paper and metal foil-paper together.

In some examples, the thickness of the first distinct layer (121) (i.e. the ink fixation layer) is ranging from about 0.001 nanometers (nm) to about 100 nanometers (nm) out of the top surface of the substrate.

The ink receiving layer (120) comprises, on top of the first distinct layer (121), a second distinct layer or ink fusion layer (122). The second distinct layer is applied, at least, on top of the first distinct layer and is part of the ink receiving layer. Without being linked by any theory, it is believed that the second distinct layer plays an important role to control the "dot gain".

"Dot gain" is the difference between the dot size on the source file and the corresponding dot size on the printed result. It refers to diameter of halftone dots increases during printing process. The got gain makes material looking darker than intended and certain degree of dot gain is desirable in order to hide any missing nozzle defect during one pass high speed inkjet printing. (However, excessive dot gain need to be avoid since it will results ink bleed defects and damage edge quality of print-out). For example, a pixel may indicate a 50% dot, but after printing, it is measured to be 70%, showing a "dot gain" of 20%. Murray-Davies equation, can computes the dot gain from density measurements according to the Equation 1 below.

$$\text{Dot Gain} = \frac{1 - 10^{(D_0 - D_N)}}{1 - 10^{(D_0 - D_{100})}} \times 100 - N \qquad \text{Equation 1}$$

In this equation, $D_0$ is the measured density of a 0% dot (i.e. unprinted substrate), $D_{100}$ is the density of a 100% dot, and $D_N$ is the density of the sample N % dot (very often, N=50). In high speed printing, a certain degree of dot gain is desirable in order to hide any missing nozzle defect during one pass of high speed inkjet printing. However, excessive dot gain need to be avoided since it will results in ink bleed defects and damage edge quality of print-out.

In some examples, the thickness of the second distinct layer (122) (i.e. the ink fusion layer) is ranging from about 0.01 nanometers (nm) to about 10 micrometer (μm); or from about 0.001 micrometer (μm) to about 5 micrometer (μm)); or from about 0.01 micrometer (μm) to about 1 micrometer (μm) out of the top surface of the first distinct layer. The coat weight of the second distinct layer (122) can be ranging from about 0.5 gsm to about 15 gsm, or from about 1 gsm to no more than 10 gsm, for example from 5 to 8 gsm.

The second distinct layer contains nano-sized inorganic pigment particles and, at least, a polymeric binder. The second distinct layer contains nano-sized inorganic pigment particles: by "nano-sized" pigment particles, it is meant herein pigments, in the form of particle, that have an average particles size that in in the nanometer sizes ($10^{-9}$ meters). Said particle are considered as either substantially spherical or irregular. In some examples, the inorganic pigment particles have an average particle size in the range of about 1 to about 150 nanometer (nm); in some other examples, the inorganic pigment particles have an average particle size in the range of about 2 to about 100 nanometer (nm).

In some examples, the surface area of the inorganic pigment particles is in the range of about 20 to about 800 square meter per gram or in the range of about 25 to about 350 square meter per gram. The surface area can be measured, for example, by adsorption using BET isotherm. In some examples, the inorganic pigment particles are pre-dispersed in a dispersed slurry form before being mixed with the composition for coating on the substrate. An alumina powder can be dispersed, for example, with high share rotor-stator type dispersion system such as an Ystral system.

In some examples, the second distinct layer (or ink fusion layer) contains from about 40 wt % to about 95 wt % of nano-size inorganic pigment particles by total weight of the second distinct layer. In some other examples, the second distinct layer contains from about 65 wt % to about 85 wt % of nano-size inorganic pigment particles by total weight of the second distinct layer. In some examples, the nano-size inorganic pigment particles, of the second distinct layer, are metal oxide or complex metal oxide particles. As used herein, the term "metal oxide particles" encompasses metal oxide particles or insoluble metal salt particles. Metal oxide particles are particles that have high refractive index (i.e. more than 1.65) and that have particle size in the nano-range such that they are substantially transparent to the naked eye. The visible wavelength is ranging from about 400 to about 700 nm.

Examples of inorganic pigments include, but are not limited to, titanium dioxide, hydrated alumina, calcium carbonate, barium sulfate, silica, high brightness alumina silicates, boehmite, pseudo-boehmite, zinc oxide, kaolin clays, and/or their combination. The inorganic pigment can include clay or a clay mixture. The inorganic pigment filler can include a calcium carbonate or a calcium carbonate mixture. The calcium carbonate may be one or more of ground calcium carbonate (GCC), precipitated calcium carbonate (PCC), modified GCC, and modified PCC. The inorganic particles that can also be selected from the group consisting of aluminum oxide ($Al_2O_3$), silicon dioxide ($SiO_2$), nanocrystalline boehmite alumina (AlO(OH)) and aluminum phosphate ($AlPO_4$). In some other examples, the inorganic particles are aluminum oxide ($Al_2O_3$) or silicon dioxide ($SiO_2$). Example of such inorganic particles is for examples, Disperal® HP-14, Disperal® HP-16 and Disperal® HP-18 available from Sasol Co.

In some examples, the nano-size inorganic pigment particles of the second distinct layer are calcium carbonate, aluminum oxide ($Al_2O_3$) or silicon dioxide ($SiO_2$). In some other examples, the nano-size inorganic pigment particles of the second distinct layer are calcium carbonate.

The nano-size inorganic pigment particles could also be a "colloidal solution" or "colloidal sol". Said colloidal sol is a composition that nano-size particles with metal oxide structure such as aluminum oxide, silicon oxide, zirconium oxide, titanium oxide, calcium oxide, magnesium oxide, barium oxide, zinc oxide, boron oxide, and mixture of two or more metal oxide. In some examples, such as the colloidal sol is a mixture of about 10 to 20 wt % of aluminum oxide and about 80 to 90 wt % of silicon oxide. In some examples, such as the colloidal sol is a mixture of about 14 wt % of aluminum oxide and about 86 wt % of silicon oxide. The nano-size inorganic pigment particles can be, in the aqueous solvent, either cationically or anionically charged and stabilized by various opposite charged groups such as chloride, sodium ammonium and acetate ions. Examples of colloidal sol are commercial available under the tradename Nalco 8676, Nalco 1056, Nalco 1057, as supplier by NALCO Chemical Company; or under the name Ludox®/Syton® such as Ludox® HS40 and HS30, TM/SM/AM/AS/LS/SK/CL-X and Ludox® TMA from Grace Inc.; or under the name Ultra-Sol 201A-280/140/60 from Eminess Technologies Inc.

The colloidal sol can also be prepared by using particles agglomerates which have the chemical structure as descripted above but which have starting particles size in the range of about 5 to 10 micrometer (10−6 meters). Such colloidal sol can be obtained by breaking agglomerates using chemical separation and mechanical shear force energy. Monovalent acids such as nitric, hydrochloric, formic or acetic with a PKa value of 4.0 to 5.0 can be used. Agglomerates are commercial available, for example, from Sasol, Germany under the tradename of Disperal® or from Dequenne Chimie, Belgium under the Dequadis HP.

With regard to the nano-size inorganic pigment particles, the second distinct layer may further include second particles that have a size range that is at least 100 times bigger than the first nano-particles (i.e. nano-size inorganic pigment particles). Such second particles can be called inorganic spacer particles, and are added in order to improve the stability of the dispersion of the first particle, for example, ground calcium carbonate such as Hydrocarb® 60 available from Omya, Inc.; precipitated calcium carbonate such as Opacarb® A40 or Opacarb®3000 available from Specialty Minerals Inc. (SMI); clay such as Miragloss® available from Engelhard Corporation; synthetic clay such as hydrous sodium lithium magnesium silicate, such as, for example, Laponite® available from Southern Clay Products Inc., and titanium dioxide ($TiO_2$) available from, for example, Sigma-Aldrich Co. The second type of the particles (inorganic spacer particles) can be other kind particles or pigments. Examples of inorganic spacer particles include, but are not limited to, particles, either existing in a dispersed slurry or in a solid powder, of polystyrene and its copolymers, polymethyacrylates and their copolymers, polyacrylates and their copolymers, polyolefins and their copolymers, such as polyethylene and polypropylene, a combination of two or more of the polymers. The inorganic spacer particles may be chosen from silica gel (e.g., Silojet® 703C available from Grace Co.), modified (e.g., surface modified, chemically modified, etc.) calcium carbonate (e.g., Omyajet® B6606, C3301, and 5010, all of which are available from Omya, Inc.), precipitated calcium carbonate (e.g., Jetcoat® 30 available from Specialty Minerals, Inc.), and combinations thereof.

The second distinct layer contains nano-size inorganic pigment particles and, at least, one polymeric binder. Without being linked by any theory, it is believed that the polymeric binder is used to provide adhesion among the inorganic particles within the second distinct layer. The polymeric binder is also used to provide adhesion between the image first distinct layer and second distinct layer. In some examples, the polymeric binder is present in the second distinct layer in an amount representing from about 5 parts by dry weight to 25 parts by dry weight per 100 parts of nano particles.

The polymeric binder can be either water a soluble, a synthetic or a natural substances or an aqueous dispersible substance like polymeric latex. In some other examples, the polymeric binder is polymeric latex. The polymeric binder can be a water soluble polymer or water dispersible polymeric latex. The binder may be selected from the group consisting of water-soluble binders and water dispersible polymers that exhibit high binding power for base paper stock and pigments, either alone or as a combination. In some examples, the polymeric binder components have a glass transition temperature (Tg) ranging from −10° C. to +50° C. The way of measuring the glass transition temperature (Tg) parameter is described in, for example, Polymer Handbook, 3rd Edition, authored by J. Brandrup, edited by E. H. Immergut, Wiley-Interscience, 1989.

Suitable binders include, but are not limited to, water soluble polymers such as polyvinyl alcohol, starch derivatives, gelatin, cellulose derivatives, acrylamide polymers, and water dispersible polymers such as acrylic polymers or copolymers, vinyl acetate latex, polyesters, vinylidene chloride latex, styrene-butadiene or acrylonitrile-butadiene copolymers. Non-limitative examples of suitable binders include styrene butadiene copolymer, polyacrylates, polyvinylacetates, polyacrylic acids, polyesters, polyvinyl alcohol, polystyrene, polymethacrylates, polyacrylic esters, polymethacrylic esters, polyurethanes, copolymers thereof, and combinations thereof. In some examples, the binder is a polymer and copolymer selected from the group consisting of acrylic polymers or copolymers, vinyl acetate polymers or copolymers, polyester polymers or copolymers, vinylidene chloride polymers or copolymers, butadiene polymers or copolymers, styrene-butadiene polymers or copolymers, acrylonitrile-butadiene polymers or copolymers. In some other examples, the binder component is a latex containing particles of a vinyl acetate-based polymer, an acrylic polymer, a styrene polymer, an SBR-based polymer, a polyester-based polymer, a vinyl chloride-based polymer, or the like. In yet some other examples, the binder is a polymer or a copolymer selected from the group consisting of acrylic polymers, vinyl-acrylic copolymers and acrylic-polyurethane copolymers. Such binders can be polyvinylalcohol or copolymer of vinylpyrrolidone. The copolymer of vinylpyrrolidone can include various other copolymerized monomers, such as methyl acrylates, methyl methacrylate, ethyl acrylate, hydroxyethyl acrylate, hydroxyethyl methacrylate, ethylene, vinylacetates, vinylimidazole, vinylpyridine, vinylcaprolactams, methyl vinylether, maleic anhydride, vinylamides, vinylchloride, vinylidene chloride, dimethylaminoethyl methacrylate, acrylamide, methacrylamide, acrylonitrile, styrene, acrylic acid, sodium vinylsulfonate, vinylpropionate, and methyl vinylketone, etc. Examples of binders include, but are not limited to, polyvinyl alcohols and water-soluble copolymers thereof, e.g., copolymers of polyvinyl alcohol and poly(ethylene oxide) or copolymers of polyvinyl alcohol and polyvinylamine; cationic polyvinyl alcohols; aceto-acetylated polyvinyl alcohols; polyvinyl acetates; polyvinyl pyrrolidones including copolymers of polyvinyl pyrrolidone and polyvinyl acetate; gelatin; silyl-modified polyvinyl alcohol; styrene-butadiene copolymer; acrylic polymer latexes; ethylene-vinyl acetate copolymers; polyurethane resin; polyester resin; and combination thereof. Examples of binders include Poval®235, Mowiol®56-88, Mowiol®40-88 (products of Kuraray and Clariant).

The binder may have an average molecular weight (Mw) of about 5,000 to about 500,000. In some examples, the binder has an average molecular weight (Mw) ranging from about 100,000 to about 300,000. In some other examples, the binder has an average molecular weight of about 250,000. The average particle diameter of the latex binder can be from about 10 nm to about 10 μm; in some other examples, from about 100 nm to about 5 μm; and, in yet other examples, from about 500 nm to about 0.5 μm. The particle size distribution of the binder is not particularly limited, and either binder having a broad particle size distribution or binder having a mono-dispersed particle size distribution may be used. The binder may include, but is in no way limited to latex resins sold under the name Hycar® or Vycar® (from Lubrizol Advanced Materials Inc.); Rhoplex® (from Rohm & Hass company); Neocar® (from Dow Chemical Comp); Aquacer® (from BYC Inc) or Lucidene® (from Rohm & Haas company).

In some examples, the binder is selected from natural macromolecule materials such as starches, chemical or biological modified starches and gelatins. The binder could be a starch additive. The starch additive may be of any type, including but not limited to oxidized, ethylated, cationic and pearl starch. In some examples, the starch is used in an aqueous solution. Suitable starches that can be used herein are modified starches such as starch acetates, starch esters, starch ethers, starch phosphates, starch xanthates, anionic starches, cationic starches and the like which can be derived by reacting the starch with a suitable chemical or enzymatic reagent. In some examples, the starch additives can be native starch, or modified starches (enzymatically modified starch or chemically modified starch). In some other examples, the starches are cationic starches and chemically modified starches. Useful starches may be prepared by known techniques or obtained from commercial sources. Examples of suitable starches include Penford Gum-280 (commercially available from Penford Products), SLS-280 (commercially available from St. Lawrence Starch), the cationic starch CatoSize 270 (from National Starch) and the hydroxypropyl No. 02382 (from Poly Sciences). In some examples, a suitable size press/surface starch additive is 2-hydroxyethyl starch ether, which is commercially available under the tradename Penford® Gum 270 (available from Penford Products).

In some examples, due to strong tendency of re-agglomeration of the nano particles due to change of ionic strength, the binder is a non-ionic binder. Examples of such binders are commercially available, for example, from Dow Chemical Inc. under the tradename Aquaset® and Rhoplex® emulsions, or are polyvinyl alcohol commercially available from Kuraray American Inc. under the tradename Poval®, Mowiol® and Mowiflex®.

The ink receiving layer (120) comprises a first distinct layer (121), applied on the image side of the substrate. The first distinct layer is applied below the second distinct layer (122). The first distinct layer comprise an electrical charged substance. "Electrical charged" refers to chemical substance with some atoms gaining or losing one or more electrons or protons, together with a complex ion consists of an aggregate of atoms with opposite charge. The electrical charged substance is a charged ion or associated complex ion that can de-coupled in an aqueous environment. In some examples, the electrical charged substance is an electrolyte, having a low molecular species or a high molecular species. The electrical charged substance can be present, in the first distinct layer, in an amount representing from about 0.005 gram per square meter (gsm) to 1.5 gram per square meter (gsm) of base substrate; or from about 0.2 gsm to about 0.8 gsm of base substrate in another example.

In some examples, the electrical charged substance is a water soluble divalent or multi-valent metal salt. The term "water soluble" is meant to be understood broadly as a species that is readily dissolved in water. Thus, water soluble salts may refer to a salt that has a solubility greater than 15 g/100 g $H_2O$ at 1 Atm. pressure and at 200° C.

The electrical charged substance can be a water soluble metallic salt which means that the first distinct layer (121) comprises a water soluble metallic salt. The water soluble metallic salt can be an organic salt or an inorganic salt. The electrical charged substance can be an inorganic salt; in some examples, the electrical charged substance is a water-soluble and multi-valent charged salts. Multi-valent charged salts include cations, such as Group I metals, Group II metals, Group III metals, or transition metals, such as sodium, calcium, copper, nickel, magnesium, zinc, barium, iron, aluminum and chromium ions. The associated complex ion can be chloride, iodide, bromide, nitrate, sulfate, sulfite, phosphate, chlorate, acetate ions.

The electrical charged substance can be an organic salt; in some examples, the electrical charged substance is a water-soluble organic salt; in yet some other examples, the electrical charged substance is a water-soluble organic acid salt. Organic salt refers to associated complex ion that is an organic specifies, where cations may or may not the same as inorganic salt like metallic cations. Organic metallic salt are ionic compounds composed of cations and anions with a formula such as $(C_nH_{2n+1}COO^-M^+)*(H_2O)_m$ where $M^+$ is cation species including Group I metals, Group II metals, Group III metals and transition metals such as, for example, sodium, potassium, calcium, copper, nickel, zinc, magnesium, barium, iron, aluminum and chromium ions. Anion species can include any negatively charged carbon species with a value of n from 1 to 35. The hydrates ($H_2O$) are water molecules attached to salt molecules with a value of m from 0 to 20. Examples of water soluble organic acid salts include metallic acetate, metallic propionate, metallic formate, metallic oxalate, and the like. The organic salt may include a water dispersible organic acid salt. Examples of water dispersible organic acid salts include a metallic citrate, metallic oleate, metallic oxalate, and the like.

In some examples, the electrical charged substance is a water soluble, divalent or multi-valent metal salt. Specific examples of the divalent or multi-valent metal salt used in the coating include, but are not limited to, calcium chloride, calcium acetate, calcium nitrate, calcium pantothenate, magnesium chloride, magnesium acetate, magnesium nitrate, magnesium sulfate, barium chloride, barium nitrate, zinc chloride, zinc nitrate, aluminum chloride, aluminum hydroxychloride, and aluminum nitrate. Divalent or multi-valent metal salt might also include $CaCl_2$, $MgCl_2$, $MgSO_4$, $Ca(NO_3)_2$, and $Mg(NO_3)_2$, including hydrated versions of these salts. In some examples, the water soluble divalent or multi-valent salt can be selected from the group consisting of calcium acetate, calcium acetate hydrate, calcium acetate monohydrate, magnesium acetate, magnesium acetate tetrahydrate, calcium propionate, calcium propionate hydrate, calcium gluconate monohydrate, calcium formate and combinations thereof. In some examples, the electrical charged substance is calcium chloride and/or calcium acetate. In some other examples, the metal salt is calcium chloride.

In some examples, the first distinct layer comprises, as an optional ingredient, a binder. Examples of polymeric binder that can be used in the first distinct layer are described above since the binder can be selected from the group of binders described and used for the second distinct layer. The polymeric binder, present in the first distinct layer, is independently selected from the binder, described above, that used in the second distinct layer. In some examples, the polymeric binder can be either water a soluble, a synthetic or a natural substances or an aqueous dispersible substance like polymeric latex. In some other examples, the polymeric binder is polymeric latex. The polymeric binder can be a water soluble polymer or water dispersible polymeric latex.

In addition to the above-described components, the first distinct layer and/or the second distinct layer formulations might also contain other components or additives, as necessary, to carry out the required mixing, coating, manufacturing, and other process steps, as well as to satisfy other requirements of the finished product, depending on its intended use. The additives include, but are not limited to, one or more of rheology modifiers, thickening agents, cross-linking agents, surfactants, defoamers, optical brighteners, dyes, pH controlling agents or wetting agents, and dispersing agents, for example. The total amount of additives, in the composition for forming the first distinct layer, can be from about 0.1 wt % to about 10 wt % or from about 0.2 wt % to about 5 wt %, by total dry weight of the ink receiving layer. In some examples, additives such as binders, deformers and PH adjusters can be added into the first distinct layer formulation in order to improve functional performances such as eliminating foaming during coating process. However, any the water absorption capability change before and after apply the first distinct layer, as measured by Cobb test as specified by TAPPI T441OM standard cannot excess 5% of cellulose base, or cannot excess 3% that of cellulose base.

Backing Coating Layer

In some examples, the printable recording media of the present disclosure further comprises a backing coating layer (130). The backing coating layer can also be called "curl control layer" since it primary function might be to balance the stress generated from the ink receiving layer, and provide a good control of the curl effect of the media. The backing coating layer can be applied directly on the substrate (110) on the opposite side of the ink receiving layer (120), i.e. on the side that will not receive any printed image. Said opposite side can also be called "non-imaging side" or backside. The backing coating layer (130) will not receive any image but will help the media to balance coating stress in order to prevent media curling. When present, the backing coating layer can have a coat weight ranging from about 1.0 gsm or from about 15 gsm. In some examples, the backing coating layer comprises at least one polymeric binder and, at least, a nano-size inorganic pigment particle. In some other examples, the backing coating layer is similar to the second distinct layer as described above.

Method of Making a Printable Recording Media

In some examples, according to the principles described herein, a method of making a printable recording media comprising a substrate (110) and an ink receiving layer (120) is provided. Such method encompasses: providing a substrate (110); applying a first distinct layer (121) containing an electrical charged substance; drying said a first distinct layer (121); applying a second distinct layer (122) containing, at least, a polymeric binder and nano-size inorganic pigment particles and drying said second distinct layer (122) in order to obtain on ink receiving layer (120). In some examples, a backing coating layer (130) can be applied to the non-imaging side of the media, i.e. on the opposing side of the ink receiving layer (120). In some other examples, the printable recording media can be calendered in order to obtain the desired the gloss and smoothness.

FIG. 4 is a flow chart of a method (200) for making the printable recording media according to the present disclosure. In this method, a substrate is provided (201); then a first distinct layer is applied (202) and then dried (203). A second distinct layer is applied over the first distinct layer (204) and, then, said second distinct layer is dried (205) in order to obtain an ink receiving layer that will form the coated printable recording media (206).

In some examples, the ink receiving layer (120), made of the two distinct layers, is applied to the substrate (110) on one side (on the image receiving side) of the media. In some other examples, the ink receiving layer (120) is applied to both sides of the substrate (110) (on the image receiving side and on the backside). The two distinct layers that form the ink receiving layer (120) are applied as two separate layers.

The first distinct layer (121) or ink fixation layer, can be applied to the substrate (110) by using one of a variety of suitable coating methods, for example blade coating, air knife coating, metering rod coating, size press, curtain coating, or another suitable technique. For example, the ink fixation layer may be applied using a conventional off-line coater, or use an online surface sizing unit, such as a puddle-size press, film-size press, or the like. The puddle-size press may be configured as having horizontal, vertical, and inclined rollers. In another example, the film-size press may include a metering system, such as gate-roll metering, blade metering, Meyer rod metering, or slot metering. For some examples, a film-size press with short-dwell blade metering may be used as application head to apply coating solution. The non-contact coating method example, the spray coating, is also suitable for this application.

The second distinct layer (122) is then applied over the ink fixation layer (121) or first distinct layer, in order to produce the ink receiving layer (120), using the coating method described above. In some examples, after the coating steps, the media might go through a drying process to remove water and other volatile components present in the layers and substrate. The drying pass may comprise several different drying zones, including, but not limited to, infrared (IR) dryers, hot surface rolls, and hot air floatation boxes. In some other examples, after the coating and drying steps, the coated web may receive a glossy or satin surface with a calendering or super calendering step. When a calendering step is desired, the coated product passes an online or off-line calender machine, which could be a soft-nip calender or a super-calender. The rolls, in the calender machine, may or may not be heated, and certain pressure can be applied to calendering rolls. In addition, the coated product may go through embosser or other mechanical roller devices to modify surface characteristics such as texture, smoothness, gloss, etc.

When the base substrate is base paper stock, the composition for forming the ink receiving layer can be applied on the base paper stock by an in-line surface size press process such as a puddle-sized press or a film-sized press, for example. In addition to in-line surface sizing processing, off-line coating technologies can also be used to apply the composition for forming the ink receiving layer to the print media substrate. Examples of suitable coating techniques include, but are not limited to, slot die coaters, roller coaters, fountain curtain coaters, blade coaters, rod coaters, air knife coaters, gravure applications, and air brush applications, for example.

Method for Producing Printed Images

A method for producing printed images, or printing method, includes providing a printable recording media such as defined herein; applying an ink composition on the ink receiving coating layer of the print media, to form a printed image; and drying the printed image in order to provide, for example, a printed image with enhanced quality. The printable recording media contains a substrate and, at least, an ink receiving layer including a first distinct layer comprising an electrical charged substance, and, applied on top of the first distinct layer, a second distinct layer containing, at least, a polymeric binder and nano-size inorganic pigment particles. In some examples, the printing method for producing images is an inkjet printing method. By inkjet printing method, it is meant herein a method wherein a stream of droplets of ink is jetted onto the recording substrate or media to form the desired printed image. The ink composition may be established on the recording media via any suitable inkjet printing technique. Examples of inkjet method include methods such as a charge control method that uses electrostatic attraction to eject ink, a drop-on-demand method which uses vibration pressure of a Piezo element, an acoustic inkjet method in which an electric signal is transformed into an acoustic beam and a thermal inkjet method that uses pressure caused by bubbles formed by heating ink. Non-limitative examples of such inkjet printing techniques include thus thermal, acoustic and piezoelectric inkjet printing. In some examples, the ink composition is applied onto the recording media using inkjet nozzles. In some other examples, the ink composition is applied onto the recording method using thermal inkjet printheads. In some examples, the printing method as described herein prints on one-pass only. The paper passes under each nozzle and printhead only one time as opposed to scanning type printers where the printheads move over the same area of paper multiple times and only a fraction of total ink is used during each pass. The one-pass printing puts 100% of the ink from each nozzle/printhead down all at once and is therefore more demanding on the ability of the paper to handle all of the ink in a very short amount of time.

As mentioned above, a print media in accordance with the principles described herein may be employed to print images on one or more surfaces of the print media. In some examples, the method of printing an image includes depositing ink that contains particulate colorants. A temperature of the print media during the printing process is dependent on one or more of the nature of the printer, for example. A suitable inkjet printer, according to the present method, is an apparatus configured to perform the printing processes. The printer may be a single pass inkjet printer or a multi-pass inkjet printer. The printer may include a temperature stabilization module operative to ensure maintenance of the range of ink jetting temperatures.

The printed image may be dried after printing. The drying stage may be conducted, by way of illustration and not limitation, by hot air, electrical heater or light irradiation (e.g., IR lamps), or a combination of such drying methods. In order to achieve best performances, it is advisable to dry the ink at a maximum temperature allowable by the print media that enables good image quality without deformation. Examples of a temperature during drying are, for examples, from about 60° C. to about 205° C., or from about 120° C. to about 180° C. The printing method may further include a drying process in which the solvent (such as water), that can be present in the ink composition, is removed by drying. As a further step, the printable recording media can be submitted to a hot air drying systems. The printing method can also encompass the use of a fixing agent that will retain with the pigment, present in the ink composition that has been jetted onto the media.

EXAMPLES

Ingredients:

TABLE 1

| Ingredient name | Nature of the ingredient | supplier |
|---|---|---|
| Calcium Chloride | electrical charged substance | Sigma-Aldrich |
| Calcium Acetate | electrical charged substance | Sigma-Aldrich |
| Sigma-Aldrich | binder | Penford Inc |
| Rhoplex Econext ® 110 | acrylic Binders | Dow Co |
| Hydrocarb ® H60 | inorganic pigment particulates (GCC) | Omya Inc. |
| Flexbond ® 325 | polymeric binder | Rosco |
| Foamaster ® VF | defoamer | BASF |
| Dynwet ®800 | surfactant | BYK Inc. |
| Mowiol ® 6-98 | polyvinyl alcohol (PVA) binder | Kurraray |
| Mowiol ® 40-88 | polyvinyl alcohol (PVA) binder | Kurraray |
| Opercab ® A40 | inorganic pigment particulates (PCC) | SMI |
| Roven ® 4040 | polyacrylic latex | Mallard Creek Polymers |
| Disperal ® HP-14 | inorganic pigment particulates (Alumina) | Sasol Co. |

Example 1—Ink Receiving Layer Formulations

The formulation of the two distinct layers (first and second layer) that form the ink receiving layer (120) are expressed in Tables 2 and 3 below (Formulation B5 is a comparative example). The numbers represent the dry parts of each component present in each layer.

TABLE 2

| First distinct layer | B1 | B2 | B3 | B4 | B5 (comp.) |
|---|---|---|---|---|---|
| Calcium Chloride | 1 | — | 1 | 1 | — |
| Calcium Acetate | — | 5 | — | — | — |
| Penford ® 280 | — | — | 10 | — | — |
| Rhoplex Econext ®110 | — | — | — | 10 | |
| Hydrcarb ®H60 | — | — | — | — | 100 |
| Flexbond ®325 | — | — | — | — | 12 |
| Foamaster ®VF | — | — | — | — | 0.3 |
| Dynewet ®800 | — | — | — | — | 0.5 |
| Mowiol ® 6-98 | — | — | — | — | 5 |
| Water | 99 | 95 | 89 | 89 | 40 |

TABLE 3

| Second distinct layer | F1 | F2 |
|---|---|---|
| Opercab ®A40 | 100 | — |
| Mowiol ®6-98 | 3 | — |
| Roven ®4040 | 15 | — |
| Foamaster ®VF | 0.2 | — |
| DYNEWET ®800 | 0.5 | 1 |
| Disperal ® HP-14 | — | 100 |
| Mowiol ® 40-88 | — | 10 |

Example 2—Printable Recording Media

Series of coated media samples (samples 1 to 10) are coated with the ink receiving layer prepared with the first distinct layer and the ink fusion layer coating compositions as shown in Tables 2 and 3. A first distinct layer, or ink fixation layer, composition (B1, B2, B3 and B4), as exemplified in Table 2, is applied to one side of a cellulose base (110) at a coat-weigh of about 0.65 gsm. B5 is applied with a coat weight of 10 gsm. On top of this first distinct layer, the second layer, or ink fusion layer, F1 or F2 is applied, as exemplified in Table 3, at a coat-weigh of about 7 gsm. On the opposite side of the cellulose base (110), a back coating is applied at a coat-weigh of 5 gsm. Said back coating (BC) has the formulation of F1.

The layers are applied using a Mayer rod and then dried. The media are then calendered through a two-nip soft nip calendering machine (at 100 kN/m, 54.4° C. (130° F.)) in order to obtain the coated printable recording media sample (1) to (10). The base substrate (110) has a basis weight of 165 gsm. The base is made of fibers pulps that contains about 80% hardwood fibers and 20 about % soft wood fibers. The base also contains about 11 wt % inorganic fillers (mixture of carbonates titanium dioxide and clays). The filler is added to the fiber structure of the raw base at wet end. The composition of the obtained printable recording media samples (Sample 1 to Sample 10) are illustrated in Table 4.

TABLE 4

| | First distinct layer | Second distinct layer | Back coating |
|---|---|---|---|
| Sample 1 | B1 | F1 | BL |
| Sample 2 | B1 | F2 | BL |
| Sample 3 | B2 | F2 | BL |
| Sample 4 | B3 | F1 | BL |
| Sample 5 | B4 | F1 | BL |
| Sample 6 | B1 | F2 | none |
| Sample 7 (comp.) | B5 | F1 | BL |
| Sample 8 (comp.) | B5 | F2 | BL |
| Sample 9 (comp.) | Polyethylene, extruded Photo base | F2 | none |
| Sample 10 (comp.) | None | F2 | BL |

Example 3—Printable Recording Media Performances

An identical image sequence is printed on the printable media samples 1 to 10. The different recording media samples (1 to 10) are measured for different parameters and properties. Such parameters and properties are expressed in Table 5 below. After printing, the image quality of the prints, including bleeding, coalescence, dry time and print mottle, is evaluated visually. The samples are then given a rating score according to a 1 to 5 scale (wherein 1 means the worst performance and 5 represents the best performance). The global images performances are also evaluated.

Gamut Measurement (Gamut) represents the amount of color space covered by the ink on the media. Gamut volume is calculated using L*a*b* values of 8 colors (cyan, magenta, yellow, black, red, green, blue, white) measured with an X-RITE® 939 Spectro-densitometer (X-Rite Corporation), using D65 illuminant and 2° observer angle. L*min value testing is carried out on a black printed area and is measured with an X-RITE® 939 Spectro-densitometer, using D65 illuminant and 2° observer angle. This measure determines how "black" the black color is. A lower score indicates a better performance. Bleed testing is carried out with a bleed stinger pattern. 1016 micron lines (or 40 mil, where 1 mil=$1/1000^{th}$ of an inch) of cyan, magenta, yellow, black, red, green, blue inks, passing through solid area fills of each color, are printed and scanned. The bleed is evaluated visually for acceptability. The "coco/worm" measurement is a visual evaluation of the banding on certain color wherein the uniformity of the color is evaluated visually. The "nozzle defect" measurement is a visual evaluation on how well the media could hide missing nozzles. Several diagnostic plot are printed in which missing nozzles are create (nozzle that consistently fails to eject drops on the black, cyan and magenta color).

The results of these tests are illustrated in Table 5. According to such results, it can be seen that the media according to the present of the present disclosure provides the best overall scores on image quality.

TABLE 5

| Sample ID | overall image quality | Nozzle Defects | Gamut (K) | L*min | Bleed | Coco/ Worm | Coalescence | Dry Time | Mottle |
|---|---|---|---|---|---|---|---|---|---|
| Sample 1 | Excellent | 3 | 357K | 12.8 | 4 | 4.5 | 4 | 4 | 3 |
| Sample 2 | Excellent | 3+ | 360K | 13.2 | 4 | 5 | 4 | 4.5 | 3.5 |
| Sample 3 | good | 3 | 368K | 11.3 | 4– | 4.5 | 4 | 4 | 3.5 |
| Sample 4 | Excellent | 3+ | 363K | 11.5 | 3.5 | 4.5 | 4 | 4.5 | 3.5 |
| Sample 5 | Excellent | 3 | 353K | 12.4 | 4– | 4.5 | 4 | 4.5 | 3.5 |
| Sample 6 | Excellent | 3+ | 325K | 10.5 | 3.5 | 4.5 | 4 | 4 | 3.5 |
| Sample 7 | Poor | 1 | 370K | 7.0 | 4– | 2 | 3.5 | 1 | 3 |
| Sample 8 | Poor | 1 | 365K | 6.7 | 4 | 2 | 3 | 1.5 | 3 |
| Sample 9 | Poor | 1– | 420K | 6.5 | 4 | 1 | 5 | 1 | 4+ |
| Sample 10 | Very poor | 3+ | 165K | 22.0 | 1 | 5 | 1 | 5 | 1 |

The invention claimed is:

1. A printable recording media comprising a substrate, and, at least, an ink receiving layer that includes a first distinct layer consisting of an electrical charged substance and an organic binder, and, on top of said first distinct layer, a second distinct layer containing, at least, a polymeric binder and nano-size inorganic pigment particles, wherein the first distinct layer and the second distinct layer, of the ink receiving layer, have a difference in coating thickness in Z-direction that is, at least, 1:10.

2. The printable recording media, according to claim 1, wherein the ink receiving layer is applied to one side of the substrate and forms a layer having a coat weight in the range of about 0.5 gsm to about 30 gsm.

3. The printable recording media, according to claim 1, that further comprises a backing coating layer that is applied, on the substrate, on the opposite side of the ink receiving layer.

4. The printable recording media, according to claim 3, wherein the backing coating layer is applied at a coat weight ranging from about 1.0 gsm to about 15 gsm.

5. The printable recording media, according to claim 1, wherein, in the first distinct layer, the electrical charged substance is a water soluble divalent or multi-valent metallic salt.

6. The printable recording media, according to claim 1, wherein, in the first distinct layer, the electrical charged substance is calcium chloride and/or calcium acetate.

7. The printable recording media, according to claim 1, wherein the first distinct layer has a thickness in the range of about 0.001 nanometers to about 100 nanometers out of a top surface of the substrate.

8. The printable recording media, according to claim 1, wherein the second distinct layer contains from about 40 wt % to about 95 wt % of the nano-size inorganic pigment particles by total weight of the second distinct layer.

9. The printable recording media, according to claim 1, wherein the nano-size inorganic pigment particles have an average particle size in the range of about 1 nanometer to about 150 nanometers.

10. The printable recording media, according to claim 1, wherein, in the second distinct layer, the nano-size inorganic pigment particles are metal oxide or complex metal oxide particles.

11. The printable recording media, according to claim 1, wherein in the second distinct layer, the nano-size inorganic pigment particles are calcium carbonate, aluminum oxide ($Al_2O_3$) or silicon dioxide ($SiO_2$).

12. An article comprising a cellulose paper substrate having, on its image side, an ink fixation layer and an ink fusion layer wherein the ink fusion layer is applied over the ink fixation layer as a distinct layer and wherein the difference in coating thickness in Z-direction is, at least, 1:10, and wherein the ink fixation layer consists of an electrical charged substance and an organic binder.

13. A method for making a printable recording media comprising:

a) providing a substrate;

b) applying a first distinct layer consisting of an electrical charged substance and an organic binder on the substrate;

c) drying said first distinct layer;

d) applying a second distinct layer containing, at least, a polymeric binder and nano-size inorganic pigment particles on the first distinct layer;

e) drying said second distinct layer in order to obtain an ink receiving layer;

wherein the first distinct layer and the second distinct layer, of the ink receiving layer, have a difference in coating thickness in Z-direction that is, at least, 1:10.

14. The printable recording media, according to claim 1, wherein the substrate is an uncoated plain paper.

15. A printable recording media comprising a substrate, and, at least, an ink receiving layer that includes a first distinct layer comprising an electrical charged substance, and, on top of said first distinct layer, a second distinct layer containing, at least, a polymeric binder and nano-size inorganic pigment particles, wherein the first distinct layer and the second distinct layer, of the ink receiving layer, have a difference in coating thickness in Z-direction that is, at least, 1:10, and wherein the first distinct layer has a coat weight of about 0.65 gsm.

* * * * *